US005148560A

United States Patent [19]

Torres

[11] Patent Number: 5,148,560

[45] Date of Patent: Sep. 22, 1992

[54] SHEET GARTER

[76] Inventor: Nelia R. Torres, 235 SW. Le Jeune Rd., Miami Springs, Fla. 33134

[21] Appl. No.: 741,926

[22] Filed: Aug. 8, 1991

[51] Int. Cl.[5] ..... A47G 9/04

[52] U.S. Cl. ..... 5/496; 24/72.5

[58] Field of Search ..... 5/496-502; 24/72.5

[56] References Cited

U.S. PATENT DOCUMENTS

| | | | |
|---|---|---|---|
| 524,834 | 8/1894 | Mayent | 25/72.5 |
| 2,024,050 | 12/1935 | May | 5/498 |
| 2,321,394 | 6/1943 | King | 24/72.5 |
| 2,459,497 | 1/1949 | Calabro | 5/496 |
| 2,930,053 | 3/1960 | Nowels | 5/496 |
| 4,199,830 | 4/1980 | Ogata | 5/498 |
| 4,829,617 | 5/1989 | Dameron | 24/72.5 |

*Primary Examiner*—Alexander Grosz

[57] ABSTRACT

A device for keeping in place fitted sheets covering a mattress. The device includes a central sheet with substantially the same shape as the mattress but with smaller dimensions. The elastic members are attached to the periphery of the central sheet pulling inwardly the fitted sheet. The elastic members are permanently affixed to the central sheet on one end and removably grab the edges of the fitted sheet keeping it in place.

1 Claim, 1 Drawing Sheet

SHEET GARTER

BACKGROUND OF THE INVENTION

1. Field of the Invention.

The present invention relates to sheet garters, and more particularly, to those holders/garters for fitted bed sheets.

2. Description of the Related Art.

It is a frequent problem to find the fitted sheet covering the mattress to come off, and sometimes pulling this sheet from the sides could become an inconvenient task. A number of devices have been designed in the past to solve this problem. These devices, however, fail to solve the problem in a simple and efficient manner.

Applicant believes that the closest reference corresponds to U.S. Pat. No. 2,930,053 issued to Nowels. However, it differs from the present invention because it provides a pulling force through its radially disposed tubular guides that is not at an angle with respect to the area of the fitted sheet being pulled. This necessarily requires guides 17 to be sewn or somehow connected to the bottom of the mattress.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a holder for fitted sheets that can effectively exert an adequate amount of inwardly directed force from the inner and lower corners of the fitted sheet covering a mattress of conventional beds and water beds.

It is another object of this invention to provide such a device that can be easily adjusted to varying characteristics and sized of the fitted sheets being held in place.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
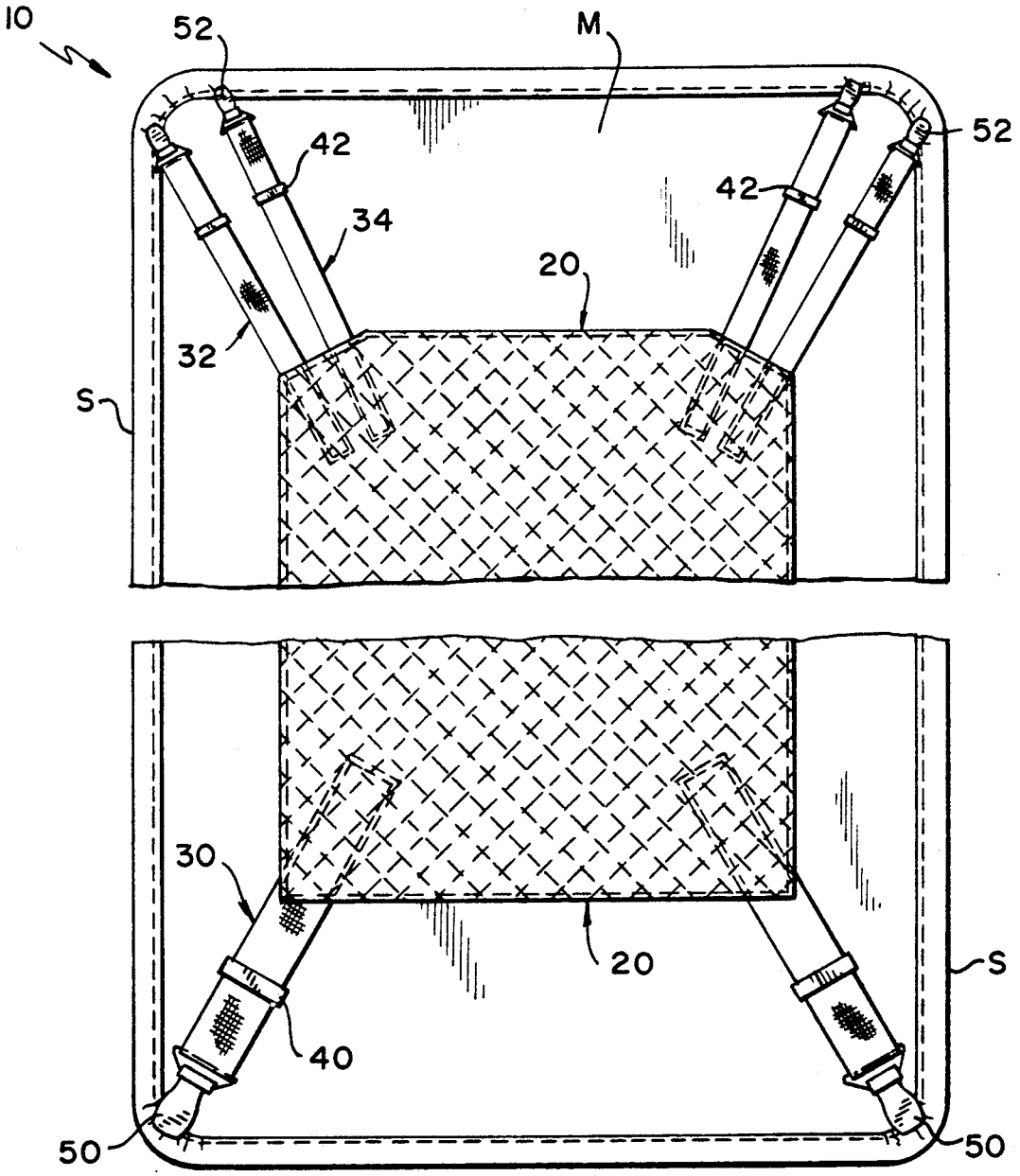
FIG. 1 represents a bottom view of the present invention showing two ends, and broken in the middle, illustrating how it is used on a conventional mattress.

Referring now to the drawings, where the present invention is generally referred to with numeral 10, it can be observed that it basically includes central sheet

20 that has a substantially rectangular shape smaller in dimensions than the mattress M with which it is being used. Preferably, sheet 20 is made out of washable material. The upper half represents one of the preferred embodiments wherein two elastic members (suspender-like) 32 and 34 are securely attached to the two corners of sheet 20 at one of their ends. In this preferred embodiment all four corners may have a pair of elastic members 32 and 34 with length adjusting assemblies 42. The other ends of elastic members 32 and 34 terminate with holding clip assemblies 52 that removably grab the edges of fitted sheet S. An inwardly pulling force exerted on the edges through the proper adjustment of assemblies 42.

The lower half of FIG. 1 shows an alternate embodiment wherein only one elastic member 30 is secured to the corners of central sheet 20 at one end. The other end of elastic members 30 include holding clip assembly 50 that removably grabs the edge of sheet S, as in the main preferred embodiment. Similarly, length adjusting assemblies 40 permit the adequate and necessary adjustment of elastic members 30 so that a sufficient pulling force is exerted on the edges of sheet S. The weight of mattress m and the weight of the users keep central sheet S in place.

This invention is particularly useful after fitted sheets S lose the elastic characteristics of its corners after being washed several times. The present invention can be used with fitted sheets utilized in conventional beds as well as water beds.

Another feature of the present invention is that through length adjustment assemblies 40 and 42, the inwardly pulling force can be maintained even if the elastic member wears out.

It is believed the foregoing description conveys the best understanding of the objects and advantages of the present invention. different embodiments may be made of the inventive concept of this invention. It is to be understood that all matter disclosed herein is to be interpreted merely as illustrative, and not in a limiting sense.

What is claimed is:

1. A device for keeping in place a fitted sheet covering a mattress and said fitted sheet having an edge, comprising:

A A generally rectangular central sheet member having substantially the same projected shape as said mattress and having smaller dimensions and said central sheet member being positioned generally centrally under said mattress; and B A plurality of elastic members each having two ends and one of said ends being securely attached to corners areas of said central sheet and the other end being removably attached to said edge and said elastic members further including means for adjusting their lengths so that sufficient inwardly force is applied to said fitted sheet edge to keep them in place, the central sheet having a total of eight elastic members, with two elastic members attached to each of the four corner areas of said generally rectangular central sheet.

* * * * *